United States Patent [19]

Sprott et al.

[11] 4,220,417

[45] Sep. 2, 1980

[54] APPARATUS FOR PRODUCING PRELIMINARY CHARACTER PRINTOUT OF TEXT AND INSTRUCTION CODES OF WORD PROCESSING APPARATUS

[75] Inventors: Charles N. Sprott; Leonard S. Yates, both of Austin, Tex.

[73] Assignee: International Business Machines Corporation, Armonk, N.Y.

[21] Appl. No.: 913,617

[22] Filed: Jun. 8, 1978

Related U.S. Application Data

[63] Continuation-in-part of Ser. No. 883,443, Mar. 6, 1978, abandoned.

[51] Int. Cl.[3] ..... B41J 5/30

[52] U.S. Cl. ..... 400/70; 400/63; 400/76; 400/74; 400/171; 364/900; 400/279

[58] Field of Search ..... 400/61, 62, 63, 70, 400/74, 76, 81, 104, 105, 149, 150, 151, 151.1, 171, 172, 279, 280, 281, 707.5; 364/900

[56] References Cited

U.S. PATENT DOCUMENTS

| | | | |
|---|---|---|---|
| 2,762,485 | 9/1956 | Bafour et al. | 400/70 X |
| 2,947,357 | 8/1960 | Bafour et al. | 400/70 X |
| 3,015,377 | 1/1962 | Reitfort | 400/70 X |
| 3,675,216 | 7/1972 | James | 364/900 |
| 3,753,246 | 8/1973 | Kiffmeyer et al. | 364/900 |
| 3,892,303 | 7/1975 | Willcox | 400/171 |
| 3,940,746 | 2/1976 | Vittorelli | 400/63 X |
| 4,026,403 | 5/1977 | Inose et al. | 400/171 X |
| 4,084,680 | 4/1978 | Deetz | 400/63 X |

OTHER PUBLICATIONS

IBM Technical Disclosure Bulletin, "Composing Systems which Incorporate Font Changing and Impression Setting from Tape or Card Input", Hunt et al., vol. 13, No. 5, Oct. 1970, pp. 1149–1150.

IBM Technical Disclosure Bulletin, "Automatic Print Wheel Loader", Bleau, vol. 18, No. 10, pp. 3350–3351, Mar. 1976.

IBM Technical Disclosure Bulletin, "Electronic Typewriter Type-Font Coding", Cooper, vol. 19, No. 11, Apr. 1977, p. 4242.

Xerox 800 Electronic Typing System Operator Manual, Oct. 7, 1974, pp. 7, 8, 11, 87, 88, 89, 90.

*Primary Examiner*—Ernest T. Wright, Jr.

*Attorney, Agent, or Firm*—John W. Henderson, Jr.

[57] ABSTRACT

A method and apparatus associated with word processing equipment for producing a preliminary printout of accessible lines of intermixed text characters and code characters representative of the format of such text. The apparatus includes logic controlled gates for selectively gating text codes, instruction codes, and reference line number codes to a print control coupled to, and controlling the printing by, a printer. Specific networks enable the printing of "font change" instructions and identifications and characteristic identifier symbols indicative of the presence of an instruction code. Audit print codes representing material ones of the instruction codes are substituted for the usual printer functional response to those instruction codes, that is, a code representation of the instruction code is printed instead of the printer executing the instruction.

9 Claims, 17 Drawing Figures

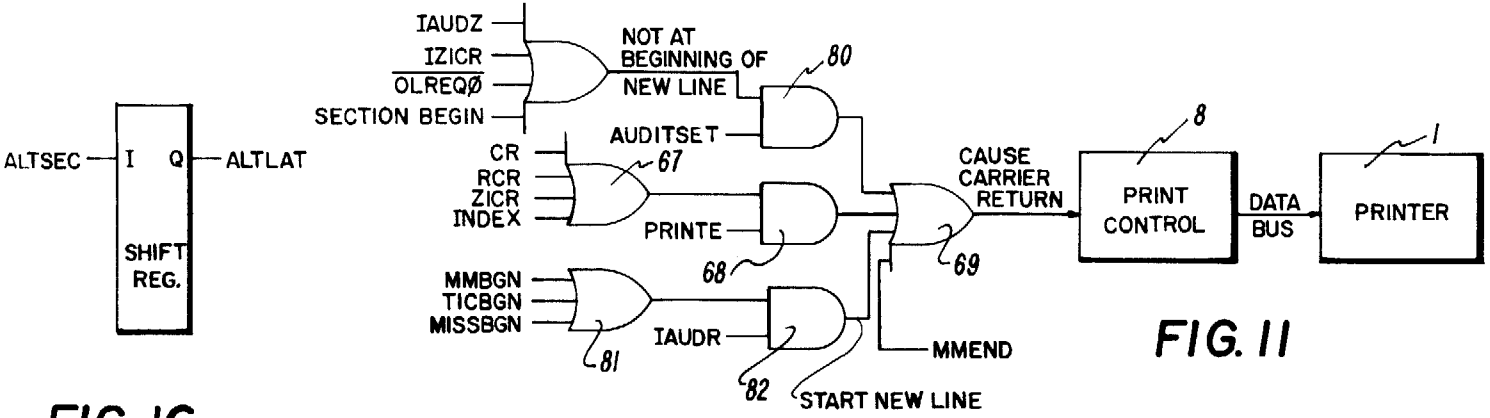
FIG. 11
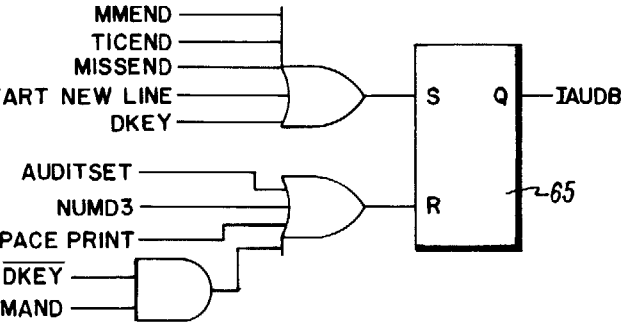
FIG. 10
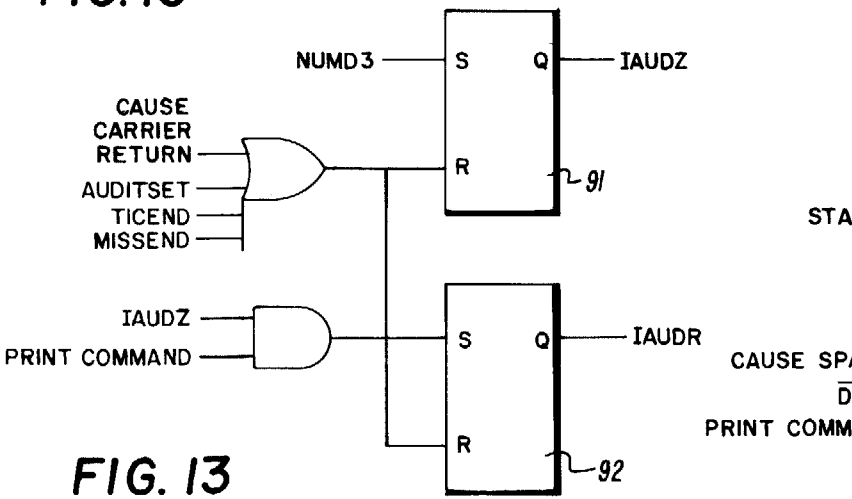
FIG. 16
FIG. 13

FIG. 12
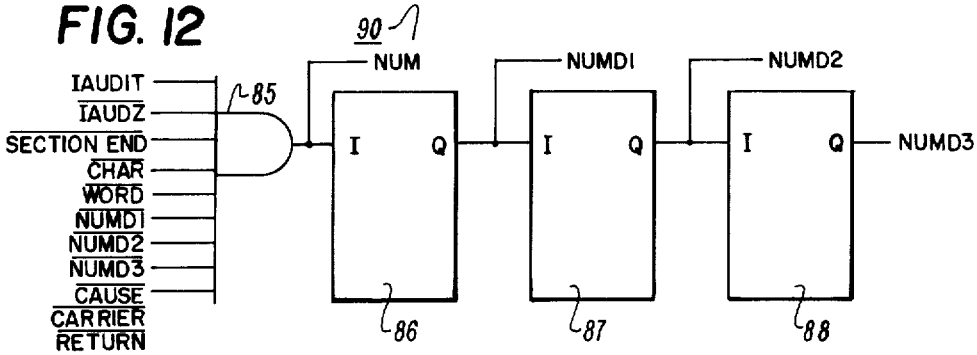
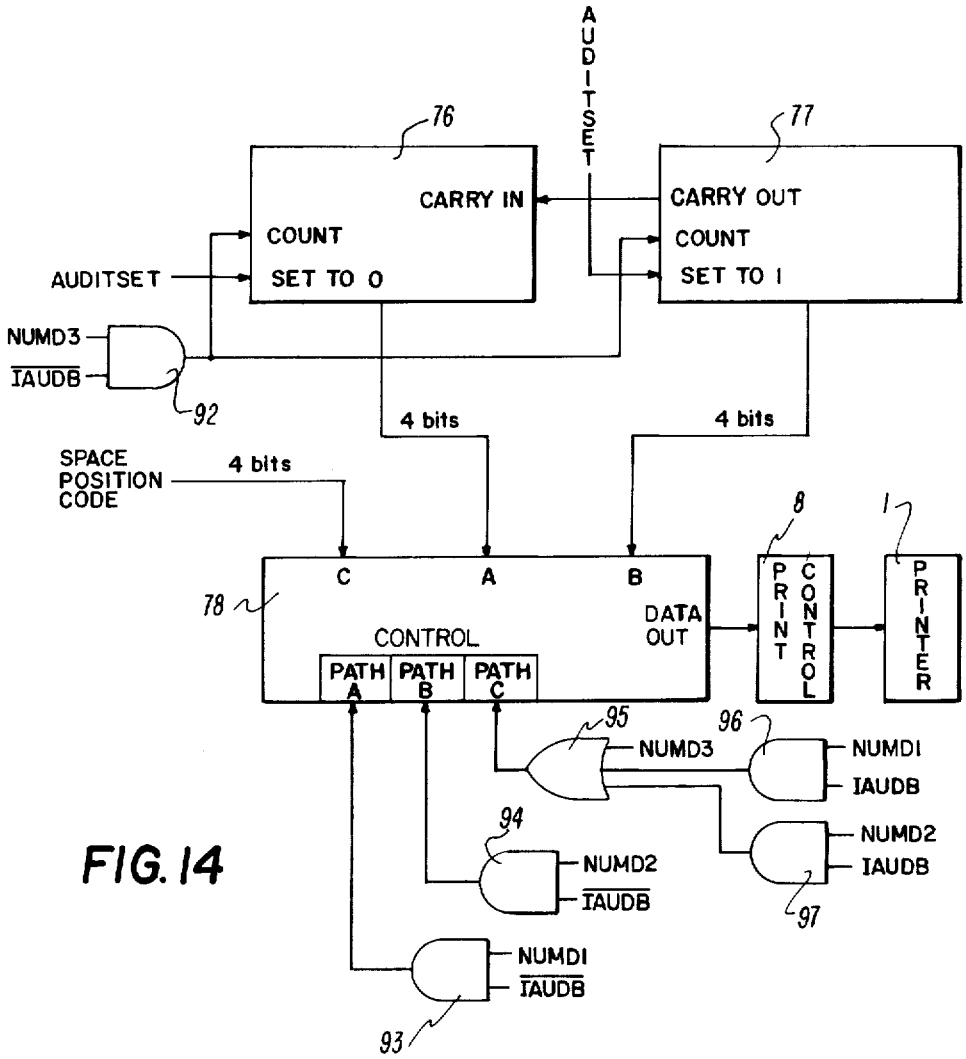
FIG. 14

APPARATUS FOR PRODUCING PRELIMINARY CHARACTER PRINTOUT OF TEXT AND INSTRUCTION CODES OF WORD PROCESSING APPARATUS

This is a continuation-in-part of application Ser. No. 883,443 filed Mar. 6, 1978, now abandoned.

BACKGROUND OF THE INVENTION

This invention relates to word processing systems, more particularly to a method and apparatus for verifying the content and format of text to be automatically printed by a word processing system, and even more particularly to a method and apparatus for producing a preliminary hard copy printout of text and instruction codes associated with such text.

Word processing systems of the type which enable the high speed, error-free production of typewritten texts are well known in the art and conventionally include a typewriter/printer in communication with, and controlled by, a memory into which the text and instruction codes for formatting such text are inputted and stored. Accordingly, the operator of the word processing system prepares an initial draft of the desired text, as well as keying in certain instructions relating to the desired format and reproduction of such text, all of this data being inputted into the memory for subsequent processing. As a consequence, numerous changes and additions to the initially-drafted text may subsequently be effected, without the need for retyping unchanged portions of the text, with error-free final drafts of the text being produced in accordance with the desired format. The use of this type equipment therefore not only substantially reduces secretarial time, but also obviates the need for the preparer of the text to constantly review portions of the text that remain unchanged, to insure the omission of typographical errors therein.

While such word processing systems therefore offer considerable advantages over the non-automatic typewriters that they are designed to replace, there are specific problems that need to be overcome in order to optimize the advantages of such systems. Specifically, it is apparent that the accurate formatting of the text requires the inputting of correct instruction codes by the operator. Thus, when a preliminary printout of the text is in the incorrect format (due to erroneous instruction codes), the operator, in order to avoid having to completely delete the incorrect formatted portion, must determine which instruction codes were inaccurate in order to correct same. Therefore, unless the system has some way to enable the operator to "look into memory", the ascertainment of the existing instruction codes must be accomplished, to a large extent, by guesswork which normally can only be accomplished by highly experienced operators. This is because the instruction codes in general cannot be "seen" on the hard copy; they are either functional, operational, or positional in nature.

In one prior art word processing system, the Xerox 800 Electronic Typing System, there is included a "Code Print" mode which, when entered, causes the system to print codes for some of the instruction codes associated with the text being keyed. However, during subsequent playout of stored text, the Xerox 800 does not print a unique character code for each instruction code but, instead prints only a limited number of instruction codes and, executes all the instruction codes.

Execution of the instruction codes provides the operator with an indication of the format of the text but does not identify the specific instruction codes used to define the format. This may be acceptable where the stored text was keyed by the same operator who is attempting to play it back or where the hard copy of the input keying is retained until subsequent play out. However, where the text is subsequently played out by a different operator, or the input copy is not retained, the operator may have difficulty in determining the input instruction codes. For example, an indentation from the left margin in a printing line can be effected by a series of spaces, a tab, a series of tabs, or a combination of spaces and tabs. Without a printout of the specific instruction codes defining the indentation, the operator is left to guesswork to determine these codes.

OBJECTS OF THE INVENTION

It is therefore a principal object of the present invention to provide a new and improved method and apparatus for enabling the operator of a word processing system to accurately determine the nature of format and related instruction codes existing in memory.

It is another object of this invention to provide a new and improved method and apparatus for effectively verifying the content of text and instruction codes associated with such text preliminary to the final printing of the text in the desired format.

It is a still further object of the present invention to enable the operator of a word processing system, at virtually any stage of the operation of such system, to obtain preliminary hard copy printouts of not only the inputted text, but also representations of certain ones of the instruction codes associated with such text.

SUMMARY OF THE INVENTION

In accordance with these and other objects, the present invention is directed to a method and apparatus for producing a preliminary printout or display of each line of text initially typed by the operator, along with visual (printed or display) representations of material ones of the instruction codes uniquely associated with such lines of text. Specifically, such preliminary printout, referred to hereinafter as Audit Print, produces the lines of text intermixed with printed characters representative of the instruction codes, along with reference line numbers immediately preceding each accessible line of so-intermixed text and instruction code characters. In accordance with specific features of the invention, all as subsequently described, the Audit Print enables the printing of a "font change" instruction, including a two-digit font number representation, as well as the printing of alternate characteristic identifier symbols indicative of the presence of an instruction code. As will be apparent from the following detailed description, the method and apparatus of the present invention enables the operator to selectively review any line of text (and determine the instruction codes associated therewith) at any time during the processing of the text without having to playout the entire text (or substantial portions thereof) or wait until the job has been completed.

BRIEF DESCRIPTION OF THE DRAWING

Specific features of the invention, as well as additional objects and advantages thereof, will become readily understood from the following detailed description taken in conjunction with the accompanying drawing, in which:

FIGS. 10, 11, 13, 15 and 16 are logic diagrams illustrating the generation of certain control signals employed in the implementation of the Audit Print process of the present invention;

FIG. 12 depicts the sequence stepper network for effecting the printout of reference line numbers in accordance with the present invention; and FIG. 14 is a combined block and logic diagram of circuitry effective to print out the reference line numbers in accordance with the invention hereof.

DESCRIPTION OF PREFERRED EMBODIMENT

Use of Audit Print in Word Processing System

Figure 1:
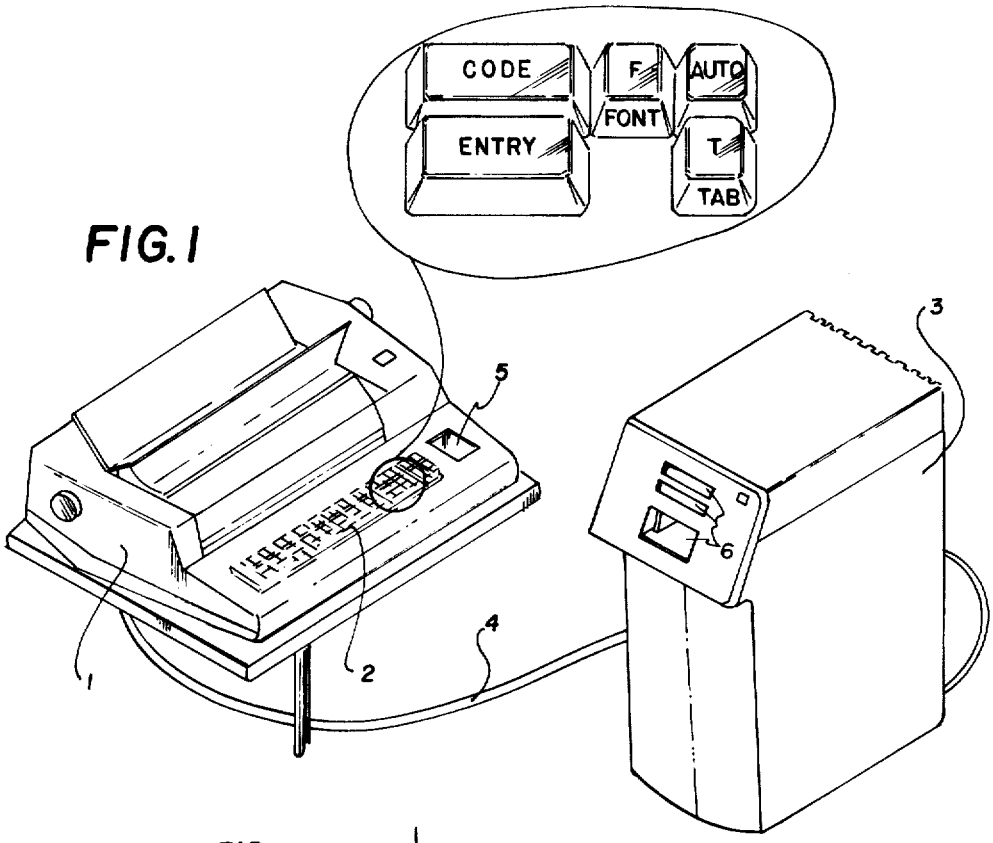
FIG. 1 is a pictorial illustration of word processing equipment, particularly depicting a typewriter/printer and control console thereof, along with an enlarged fragmentary view of a portion of the keyboard of the printer.

Referring initially to FIG. 1, a word processing system of the type generally known in the art, and with respect to which the present invention has particular applicability, is broadly depicted as including a typewriter/printer 1 with a keyboard 2, the printer 1 being in two way communication with a console 3 by way of cable 4. Disposed within the console 3 are memory and control networks for automatically recording operator-generated text and instruction codes for subsequent automatic playout of the text by the printer 1 in accordance with the desired format.

As conventionally known, the operator of the word processing system utilizes the keyboard 2 not only to type the desired text, but also to enter the various instruction codes and initiate the respective operational modes of the system. Thus, and as indicated in FIG. 1, certain keys or buttons of the keyboard 2 would be provided (when depressed) for inputting operational modes (AUTO, LINE, ENTRY, CODE, etc.) while others can be assigned to both text character and instruction code generation (illustrated example of "T" and "TAB"). It is to be understood that the orientation of the keys depicted in FIG. 1 is only illustrative and does not necessarily represent their actual orientation.

The printer 2 also includes an operator message panel 5 for displaying information to the operator as to what activity is occurring in memory; and the console 3 would normally include entry and exit openings 6 for magnetic cards of the type known as IBM Mag Cards upon which the coded text and instructions, etc. can be recorded for later use.

In accordance with the conventional use of the word processing system of FIG. 1, the operator would normally type an initial draft of the desired text, as well as "key in" certain format instructions (such as tab locations, measure length, platen index requirements) and other codes relating to the desired character print (for example, the existence of required "hyphens"). The text and associated instruction codes are then transmitted and stored within the memory in the console 3 so that, after corrections or insertions are made to the initial draft, the final form of the text may be automatically printed with a minimum of operator intervention and in accordance with the desired format.

In accordance with the Audit Print operation of the present invention, the operator, at virtually any stage of the operation of the word processing system, is able to obtain a hard-copy printout of not only the text, but also representations of certain ones of the instruction codes uniquely associated with, and controlling the format of, the text. As will subsequently be described in greater detail, such printout includes the various lines of text intermixed with printed characters respectively corresponding to (and indicating) such instructions codes along with a reference line number immediately preceding each accessible line of text. With this feature, the operator can now play back and reprint practically everything that is in memory, thus determining, for each line, not only the text but also the codes that were previously entered pertaining to such text, and then quickly access (by depressing the keys corresponding to "line advance" and "line return") a particular line in order to change or correct an existent code associated with that line of text (as well as, of course, the text itself).

For convenience of explanation, certain terminology will be utilized hereafter in the description and claims. Specifically, the term "text code" means and refers to coded representations (as they appear in memory) of the text (letters, numbers, etc.); and the term "text characters" means and refers to the actual display or hard-copy printout of such text. The term "instruction codes" means and refers to each of the codes (as they appear in memory) corresponding to the way in which the text is to be printed (and would therefore include codes instructing the placement of tabs, indent tabs, carrier returns, stops, indexing formats, etc.); and the term "audit print characters" means and refers to the actual display or printed representations of material ones of these respective instructions codes. To avoid confusion, the term "audit print instruction codes" will be used to refer to those codes which are represented by the "audit print characters" and to distinguish them, when necessary, from other instruction codes in memory.

Since both the text and audit print characters will be intermixed on the hard-copy printout, and so as to avoid operator confusion therebetween, each audit print character includes an initial symbol hereinafter referred to as "identifier symbol" followed by a second symbol hereinafter referred to as "code character". The initial "identifier symbol" will be common to every, and therefore accentuate the existence of an, "audit print character" while the foregoing "code character" uniquely specifies the particular type of audit print instruction code represented thereby. While it is to be understood that various types or combinations of symbols can be employed for the audit print characters, the following represents a summary of one set of audit print characters that have been utilized to correspond to the audit print instruction codes that they respectively represent. It will be apparent that, in such exemplary set, the commonly employed initial identifier symbol is "[":

| Audit Print Character | Corresponding Instruction Code |
|---|---|
| [ t | Tab |
| [ T | Indent Tab |
| [ c | Carrier Return |
| [ C | Required Carrier Return |
| [ i | Index (platen advance) |
| [ Z | Zero Index Carrier Return |
| [ 1 | Unit Space |
| [ 3 | 3 Unit Space |
| [ b | Unit Backspace |
| [ B | 6 Unit Backspace |
| E | Page End |
| [ - | Required Hyphen (for words that must always contain hyphen) |
| [ s | Stop Code |
| [ n | No-Print |
| [ p | No-Print End |
| [ Fnn | Font Change (Where "nn " is a two-digit font number) |
| [ o | Decimal or Comma Tab Sequence |
| [ u | Centering Sequence |

BASIC CONCEPT OF AUDIT PRINT

Figure 2:
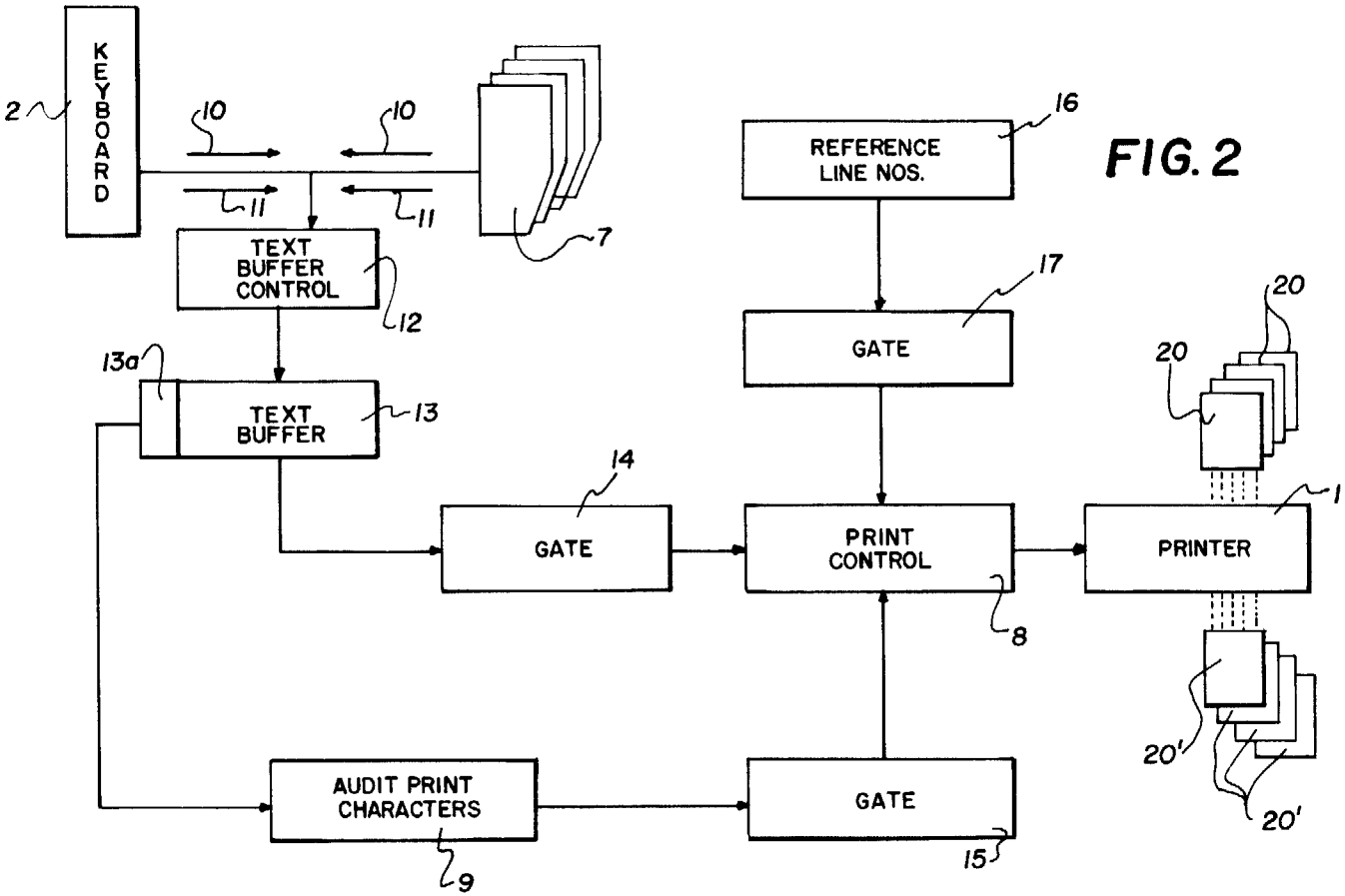
FIG. 2 is a block diagram representing the data flow in accordance with the basic concept of the present invention.

The basic concept of the Audit Print method and apparatus is pictorially represented by the data flow diagram of FIG. 2. Specifically, the text code (represented by signals 10) and the instruction codes (represented by signals 11) are inputted from the keyboard 2 (or alternatively from storage media such as magnetic cards 7) to a text buffer 13 by way of text buffer control 12. A detailed description of the design and operation of the text buffer 13 (and associated control 12) is not necessary for an understanding of the present invention, one suitable buffer and buffer control being described in U.S. Pat. No. 3,675,216. It is sufficient to note that for the purpose of the description, the text buffer 13 may essentially be a recirculating dynamic shift register for storing the inputted text and instruction codes with a control flag (byte), associated with such data, advanced to move the data out of the buffer 13.

An output from text buffer module 13 communicates, by way of a gate module 14, with a print control module 8, the output of which is in communication with printer 1. The printer 1 and associated print control 8 are of the type presently known in the art and may be of the design currently manufactured and sold by International Business Machines Corporation, the assignee of the present invention. Thus, and as subsequently described in greater detail, the text (and instruction) codes within the buffer 13 are outputted, upon actuation of the gate 14, to the print control 8, with the consequent printing of the text characters by printer 1.

Also coupled to the print control 8, by way of a gate module 15, is a module 9, the details and operation of which are subsequently described, for generating codes representative of the respective audit print characters, the input to module 9 being in communication with the text buffer 13 by way of decode portion 13*a*. Upon actuation of gate module 15, these codes are advanced to the print control 8 for consequent printing of the audit print characters by printer 1. When gate 15 is actuated, gate 14 is not actuated and the instruction code does not pass to the print control 8 for execution by the printer 1.

A third module 16 containing reference line number data communicates with the print control module 8 by way of a gate module 17 so that, upon the selective actuation of gate 17, reference line number codes are sequentially gated to the print control 8 with the consequent printing of the individual reference line numbers by printer 1.

Thus, the "Audit Print" process of the present invention involves the selective gating of text codes from the buffer 13, the audit print instruction codes from the module 9, and the reference line number data codes from the module 16, to provide an audit printout from the printer 1 which represents an intermix of the text characters and audit print characters, along with reference line numbers at the beginning of each accessible line of so-intermixed data. Thus, prior to the generation of the final copies of the text (represented in FIG. 2 by sheets 20), the operator can place the system in the Audit Print mode and produce sheets of text (represented in FIG. 2 by sheets 20') with the intermixed text and audit print characters thereupon.

For example, the printout sample of text reproduced and headed hereinafter as Final Text Sample would be typical of data printed on a sheet 20, while the sample printout followed thereafter and labeled Audit Print Sample represents the same text, but intermixed with the audit print characters corresponding to the instruction codes supporting the generation of such text. As noted, each accessible line on the Audit Print Sample is preceded by a reference line number, thus enabling the operator to quickly review, access, and correct or change any instruction associated with, a particular line. By "accessible line" is meant a line addressable by depressing the keys corresponding to "line advance" or "line return". In some instances, one "accessible line" may be two or more lines of print, but never less than one line of print. It is also noted that in the Audit Print mode the print control 8 does not cause the printer 1 to execute the instruction codes represented by the Audit Print characters. But, as can be seen in the Audit Print Sample, the printer 1 produces a compact printout of intermixed audit print characters and text characters, resulting in decreased printer operation time.

FINAL TEXT SAMPLE

Audit Print provides the oerator with a method of determining the non-printing characters and the required characters in a project.

When in Audit Print Mode, the system will replace the non-printing or required character with a sequence of printing characters as shown in the functional objectives.

The following characters will function normally after printing the appropriate Audit character:

-Carrier Return
-Required Carrier Return
-Page End

Most of the other Audit Print characters will not.
The following text will give Audit Print a workout:
second first
Indexes
between
words.
Req'd space1s between words.
Req'd space3s between words.

-continued

Req'd bksp is between words.
Req'd bksp6 between words.
Req'd hyphens were demonstrated in the first two paragraphs.
Stop codes between words.
There is a noprint sequence in this line.
There are two font changes in this line.
66.555
centered text
This text will now end with a page end code.

AUDIT PRINT SAMPLE 01 j
T t tS
t Audit Print provides the operator with a method of c
02 determining the non -printing characters and the required c
03 characters in a project. c
04 t When in Audit Print Mode, the system will replace the c
05 non -printing or required character with a sequence of c
06 printing characters as shown in the functional objectives c
07 t The following characters will function normally after c
08 printing the appropriate Audit character: c
09
c
10 T - Carrier Return c
11 - Required Carrier Return c
12 - Page End C
13 c -continued 14 t Most of the other Audit Print characters will not. c
15 The following text will give Audit Print a workout. c
16 t t t first Z
17 second c
18 Indexes i
19 between i
20 words c
21 Req'd 1 spacels 1 between 1 words c
22 Req'd 3 space3s 3 between 3 words. c
23 Req'd bbkspls bbetween b words c
24 Req'd Bbksp6s Bbetween BWords. c
25 Req'd hyphens were demonstrated in the first two para- c
26 graphs. c
27 Stop s codes s between s words. c
28 There is n a noprint sequence p in this line. c
29 There are F65 two font changes F64 in this line. c
30 t t t b o 66.555 c
31 t t t u centered text c
32 This text will now end with a page end code. IE

PREFERRED APPARATUS EMBODIMENT

There is now described the design and operation of a preferred form of apparatus effective to provide the Audit Print process of the present invention. To facilitate a clear understanding of the operation thereof, a glossary of terms identifying the various signals referred to in the following description and drawing is initially summarized as follows:

| GLOSSARY OF SIGNAL TERMS | |
|---|---|
| AUTO | Coded signal generated in response to operator initiating automatic playout mode at keyboard. |
| IAUTO | Indicator signal that system continues in automatic playout (initiated by AUTO and has not been terminated automatically or by operator intervention). |
| LINE | Coded signal generated in response to operator initiating line playout mode at keyboard. |
| ILINE | Indicator signal that system continues in line playout (initiated by LINE and has not been terminated automatically or by operator intervention). |
| WORD | Coded signal generated in response to operator initiating word playout mode at keyboard. |
| IWORD | Indicator signal that system continues in word playout (initiated by WORD and has not been terminated automatically or by operator intervention). |
| CHAR | Coded signal generated in response to operator initiating character playout mode at keyboard. |
| CODE | Coded signal generated in response to operator instructing system (at keyboard) to accept instruction codes |
| ENTRY | Coded signal generated in response to operator instructing system (at keyboard) to enter data into memory. |
| ACCESS | Coded signal generated in response to operator instructing system to move forward in memory (depression of keys indicating "paragraph advance" or "line advance") or to move back in memory (depression of keys indicating "page start" or "line return"). |
| ALTSEC | Coded signal generated in response to operator instructing system (at keyboard) to utilize an alternate section of memory during entry and playback modes. |
| ALTLAT | Signal used to detect change initiating state of alternate section button. |
| SCAN | Indicator that system is in memory scan mode. |
| EDIT | Edit code. |
| ERROR | Error code. |
| MISS | Minimum interword space code series. |
| MISSBGN | Initial minimum interword space code. |
| MISSEND | Final minimum interword space code. |
| MM | Mode/measure code series. |
| MMBGN | Initial mode/measure code. |
| MMEND | Final mode/measure code. |
| TIC | Tab/index code series. |
| TICBGN | Initial tab/index code. |
| TICEND | Final tab/index code. |
| AUDITCHAR | Indicator signal that one of the audit print instruction codes is being detected. |
| CAUSE CARRIER RETURN | Indicator that carrier return is being effected. |

-continued

| GLOSSARY OF SIGNAL TERMS | |
|---|---|
| DKEY | Signal indicating that a character is to be printed without carrier (carriage) escapement. |
| IBKM | Indicator signal that system is in blind key mode during no-print sequence. |
| INCENTER | Indicator that centering sequence is being initiated by operator. |
| INDECTAB | Indicator that decimal (or comma) tab sequence is being initiated by operator. |
| INMISS | Indicator that minimum interword space code is being initiated by operator. |
| INMM | Indicator that mode/measure code is being initiated by operator. |
| INTIC | Indicator that tab/index code is being initiated by operator. |
| OLREQ $\phi$ | One signal which indicates that carrier is at left margin. |
| PRINT COMMAND | Signal generated from print control 8 each time a text character is printed. |
| SECTION BEGIN | Indicator signal that control flag is at beginning of the current memory section. |
| SECTION END | Indicator signal that control flag is at end of the current memory section. |
| CAUSE SPACE PRINT | Signal initiating carrier escapement during Audit Print mode when audit print character to be printed is preceded by dead key character. |
| IAUDB | Control signal to defer reference line number printout and audit print character printout under certain conditions. |
| IAUDR | Control signal to institute carrier return during Audit Print mode to assure that certain non-audit print instruction codes print on lines by themselves. |
| IAUDZ | Control signal determining print time of reference line number and carrier return requirement when Audit Print is started. |
| IZICR | Signal indicating that a zero-index carrier return was the last end-of-line character. |
| ALTSYMB | Signal from font number register 62 that alternate identifier symbol is to be printed. |
| START NEW LINE | Control signal generating CAUSE CARRIER RETURN. Comes up when a Audit Print instruction code is encountered and something has already been printed on the current line (not counting the reference line number). |
| IAUDIT | Indicator signal that system is in Audit Print mode. |
| AUDITSET | Control signal intiating IAUDIT when existing conditions indicate that system is to be in Audit Print mode. |
| AUDITRESET | Control signal initiating IAUDIT when existing conditions indicate that Audit Print mode is to be terminated. |
| NUM | Signal pulse initiating reference line number print. |
| NUMDI-NUMD3 | Mutually exclusive stepper signals for sequential printing of reference line numbers. |
| NUMPRT | Indicator that reference line numbers are being processed and printed. |
| PRTSET | Signal pulse initiating audit print character print. |
| PRINTA-PRINTF | Mutually exclusive stepper signals for sequential printing of audit print character symbols. |
| TAB | Audit print instruction code for tab. |
| INDTAB | Audit print instruction code for indent tab. |
| CR | Audit print instruction code for carrier return. |
| RCR | Audit print instruction code for required carrier return. |
| ZICR | Audit print instruction code for zero-index carrier return. |
| INDEX | Audit print instruction code for platen advance. |
| UNITSP | Audit print instruction code for single unit space. |
| 3UNITSP | Audit print instruction code for three unit space. |
| UNITBKSP | Audit print instruction code for single unit backspace. |
| 6UNITBKSP | Audit print instruction code for six unit backspace. |
| PAGEND | Audit print instruction code indicating end of page. |
| REQHYP | Audit print instruction code indicating required hyphen. |
| STOP | Audit print instruction code terminating playout in modes other than Audit Print. |
| NOPRTBGN | Audit print instruction code initiating no-print sequence. |
| NOPRTEND | Audit print instruction code terminating no-print sequence. |
| FONTCHG | Audit print instruction code indicating font change. |
| DECTAB | Audit print instruction code for decimel or comma tab. |
| CENTER | Audit print instruction code for centering line of text. |

In addition, the description and drawing will also refer to signals which are the data complements of various ones of the aforelisted signals which, as conventionally known, indicate the absence of that particular signal condition. For example, the signal designation $\overline{\text{IAUDIT}}$ is the data complement of the signal IAUDIT and thus represents an indicator signal that the system is *not* in Audit Print mode.

Figure 4:
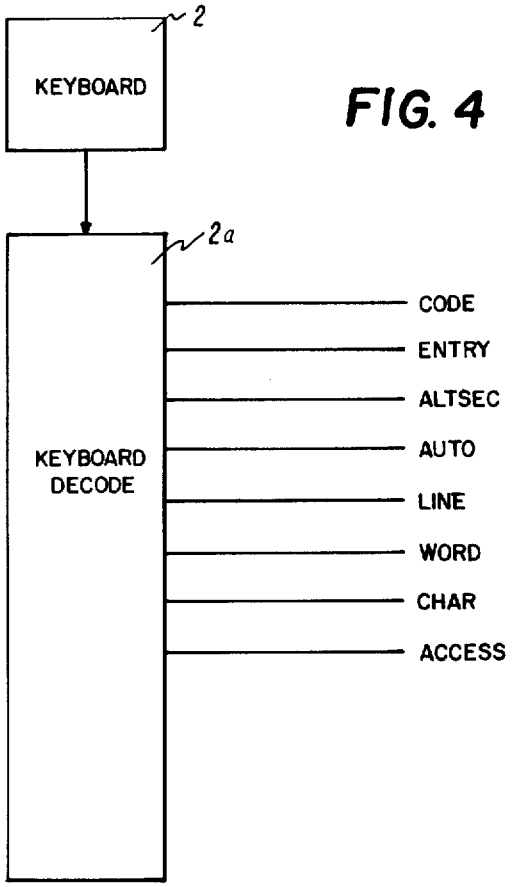
FIGS. 4 and 4A are diagrams representing the generation of certain signals used during Audit Print.
Figure 4A:
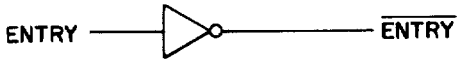

The CODE, ENTRY, ALTSEC, AUTO, LINE, WORD, CHAR, and ACCESS signals are all generated (FIG. 4) by a keyboard decode module 2*a*, the circuitry within the decode module 2*a* being conventional for generating the so-coded switching signals in response to the depression of the corresponding keys or buttons on the keyboard 2. The other signals summarized above are internally generated by the logic within the system, as subsequently described in greater detail. Furthermore, and as conventional, the data complement signals are normally produced with the use of conventional inverters, a typical example being shown in FIG. 4A.

For convenience of description, "positive logic" is assumed in describing the operation of the various logic networks. Thus, the terms "high" and "low" (or "1" and "0") are used to respectively designate the presence and absence of a particular signal. It is to be understood, however, the "negative logic" can alternately be employed in designing these networks, in which event opposite assignment would correspondingly apply.

Through the following description, it is assumed that all latches are synchronously stepped by a common clock (not shown); and the signal status at the output of the latches do not change to reflect signal information at the inputs until the occurrence of each clock. Under normal circumstances, the "set" and "reset" inputs will not be up at the same time; but in the event of such occurrence, the "set" will dominate over the "reset".

PRINTING OF TEXT CHARACTERS

Figure 3:
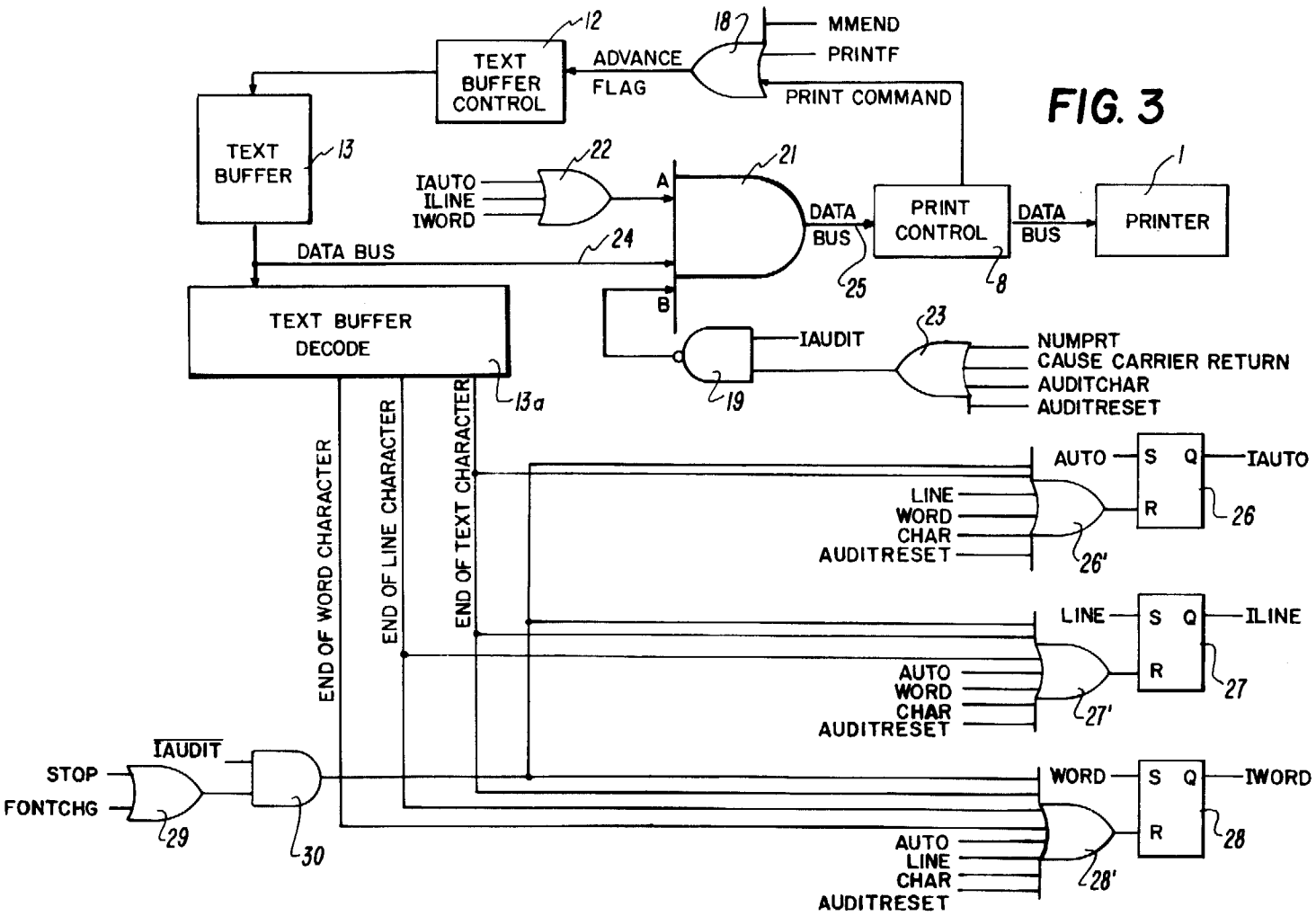
FIG. 3 is a block diagram of the logic circuitry for implementing the printing of text characters in accordance with the present invention.

Referring now to FIG. 3, the logic control circuitry for effecting (or preventing) the printing of the text characters by the printer 1 is now described. Accordingly, the sequential advancement of the control flag, and therefore the corresponding advancement of the text (and instruction) codes to the output of the text buffer 13, is effected in response to the generation of an "advance flag" signal at the output of the OR gate 18 (which is coupled to the input of the text buffer control 12). As apparent from FIG. 3, this "advance flag" will be generated (1) each time print control 8 directs the printing of a text character (with PRINT COMMAND therefore being "high"); (2) upon completion of an audit print character printout (PRINTF is "high"); or (3) after mode measure (MMEND "high").

The gate module 14 (FIG. 2) is essentially provided by an AND gate 21; and consequently, whether the data at the output of the text buffer 13 is 'gated" to the print control logic 8 (along data buses 24 and 25) depends upon whether the signals at both the inputs A and B of the AND gate 21 are "high". Such signal conditions exist as long as the system continues in either the automatic, line, or word playout mode (IAUTO, ILINE, or IWORD "high" at inpts to OR gate 22) *and* either (1) the system is not in Audit Print mode, (IAUDIT "low" at input to NAND gate 19) or (2) the system is in Audit Print mode but a reference line number is not being processed, a carrier return is not being effected, one of the eighteen audit print instruction codes is not being detected, nor does an Audit Print termination condition exist (NUMPRT, CAUSE CARRIER RETURN, AUDITCHAR, and AUDITRESET to OR gate 23 "low").

The IAUTO, ILINE, and IWORD signals are provided by latches 26, 27, and 28 respectively, OR gates 26', 27', and 28' respectively coupled to the "reset" inputs thereof. As depicted in FIG. 3, these OR gates 26', 27' and 28' have some of their inputs tied together as well as respectively connected to a corresponding output of the text buffer decode module 13*a*. AUTO, LINE and WORD outputs from keyboard decode module 2*a* (FIG. 4) are respectively applied to the "set" inputs of latches 26–28.

Thus, it is apparent that the latch 26 is set (thus generating IAUTO) when "AUTO" is "1", the latch 27 is set (thus generating ILINE) when LINE is "1", and latch 28 is set (thus generating IWORD), when WORD is "1". The latches 26–28 will then be reset (terminating IAUTO, ILINE, or IWORD, as the case may be) upon the occurrence of certain input signal conditions. For example, if IAUTO is on and an end-of-text character code (page end, end of memory section, etc.) is detected from module 13*a*, latch 26 will be reset, as well as upon the occurrence of any of the input signal condition designated LINE, WORD, CHAR, or AUDITRESET. If ILINE is on and an end-of-text character code or end-of-line character code (carrier return, etc.) is detected, latch 27 will be reset, as well as upon the occurrence of any of the input signal conditions AUTO, WORD, CHAR, or AUDITRESET. If IWORD is on and an end-of-text character code, end-of-line character code, or end-of-word character code (space) is detected, latch 28 will be reset, as well as upon the occurrence of any of the input signals AUTO, LINE, CHAR, or AUDITRESET. In addition, the latches 26–28 will be reset when the system is not in the Audit Print mode ($\overline{\text{IAUDIT}}$ to AND gate 30) and either a "stop" or "font change" condition is present (STOP or FONTCHG signal inputs to OR gate 29).

PRINTING OF AUDIT PRINT CHARACTERS

Figure 5:
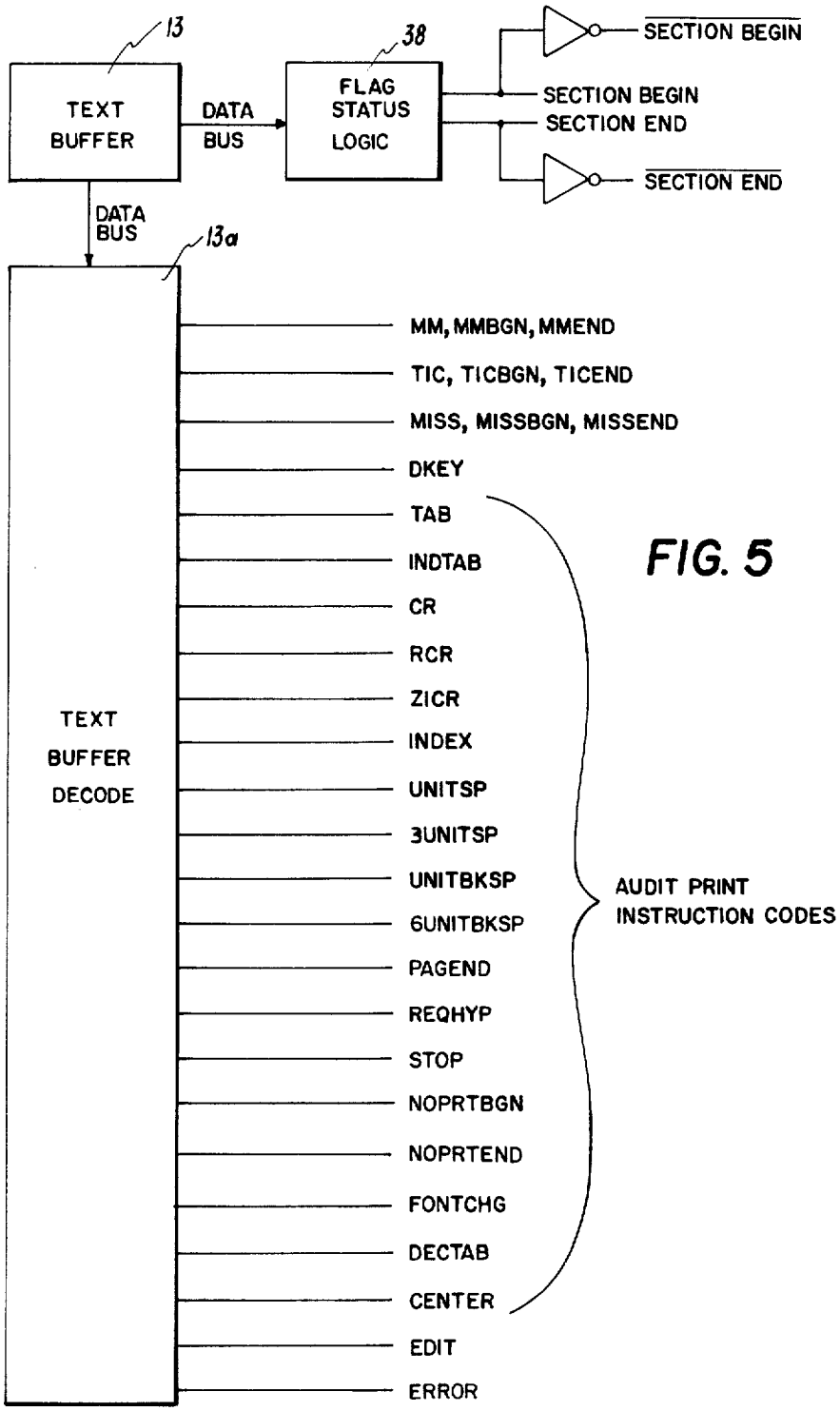
FIG. 5 is a block diagram illustrating the generation of certain control signals utilized for effecting the printing of audit print characters.

The logic circuitry for effecting the substitute printing (intermixing) of the audit print chararacters during Audit Print is now described. Preliminary to such description, it will be useful to initially discuss the method and apparatus for generating certain signals utilized for controlling such audit print character substitution. Accordingly, and with initial reference to FIG. 5, the text buffer decode modue 13*a* is effective to generate signals corresponding to the mode/measure, tab/index, minimum interword space, dead key (non-escapement printing), edit, and error codes, as well as the eighteen audit print instruction codes, existing in the text buffer 13. In addition, a flag status logic module 38 coupled to an output of the text buffer 13 is effective to generate signals indicative of the "section location" of the control flag, i.e., whether or not the flag is at the beginning or end of the section.

Figure 6:
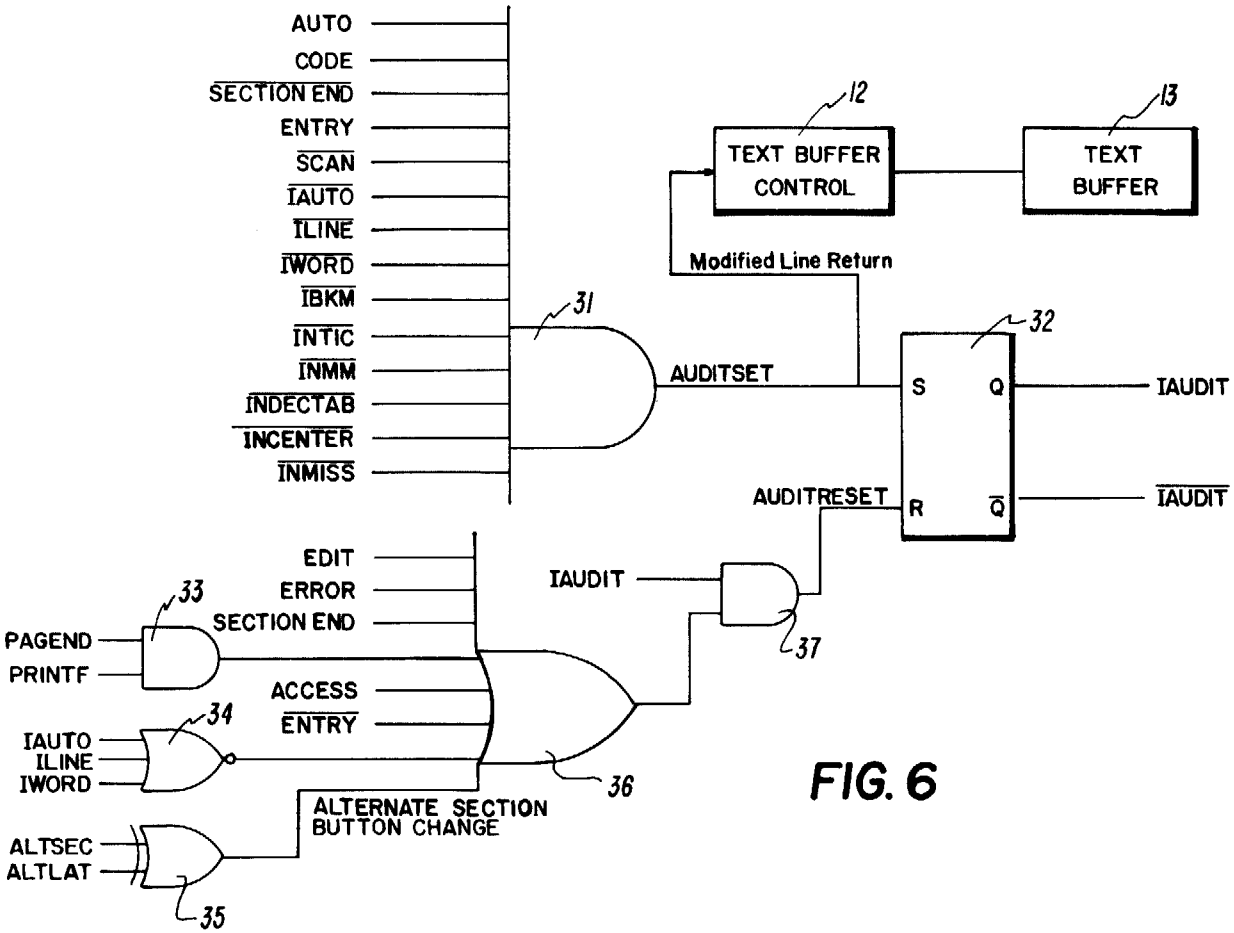
FIG. 6 is a logic diagram illustrating the generation and use of signals for initiating Audit Print in accordance with the method of the present invention.

The logic circuitry for implementing and terminating the Audit Print mode, and for indicating whether the system is (IAUDIT) or is not ($\overline{\text{IAUDIT}}$) in Audit Print mode is depicted in FIG. 6. Accordingly, AND gate 31 has its output coupled to the "set" input of latch 32; and AND gate 37 has its output coupled to the "reset" input of latch 32. Thus, to initiate the Audit Print mode, all of the signal conditions indicated at the inputs to AND gate 31 must be met, thereby generating the control signal AUDITSET, and therefore the indicator signal IAUDIT. Once initiated, the system continues in the Audit Print mode unless the latch 32 is reset (existence of AUDITRESET) in accordance with the signal conditions at the inputs to AND gate 33, NOR gate 34, EXCLUSIVE-OR gate 35, and OR gate 36.

Figure 7:
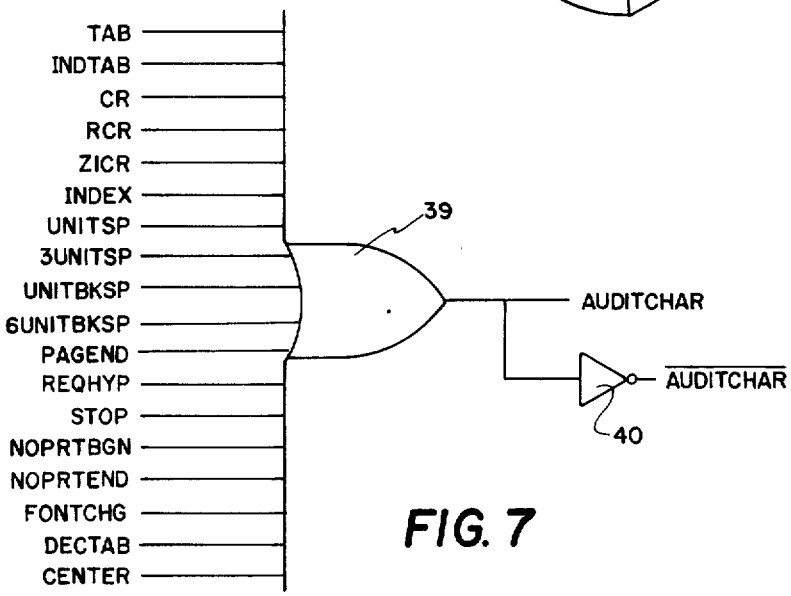
FIG. 7 is a logic diagram of circuitry utilized for detecting and indicating the presence of an audit print instruction code in accordance with the method of the present invention.

FIG. 7 depicts logic circuitry, including an OR gate 39 and inverter 40, for detecting and indicating the presence (AUDITCHAR) or absence ($\overline{\text{AUDITCHAR}}$)

of one of the eighteen audit print instruction codes in the text buffer 13, the audit print instruction code signal outputs from the text buffer decode module 13a (FIG. 5) being coupled to the inputs of the OR gate 39. FIG. 16 depicts a shift register effective to generate ALTLAT in response to an alternate section instruction code (ALTSEC).

Figure 8:
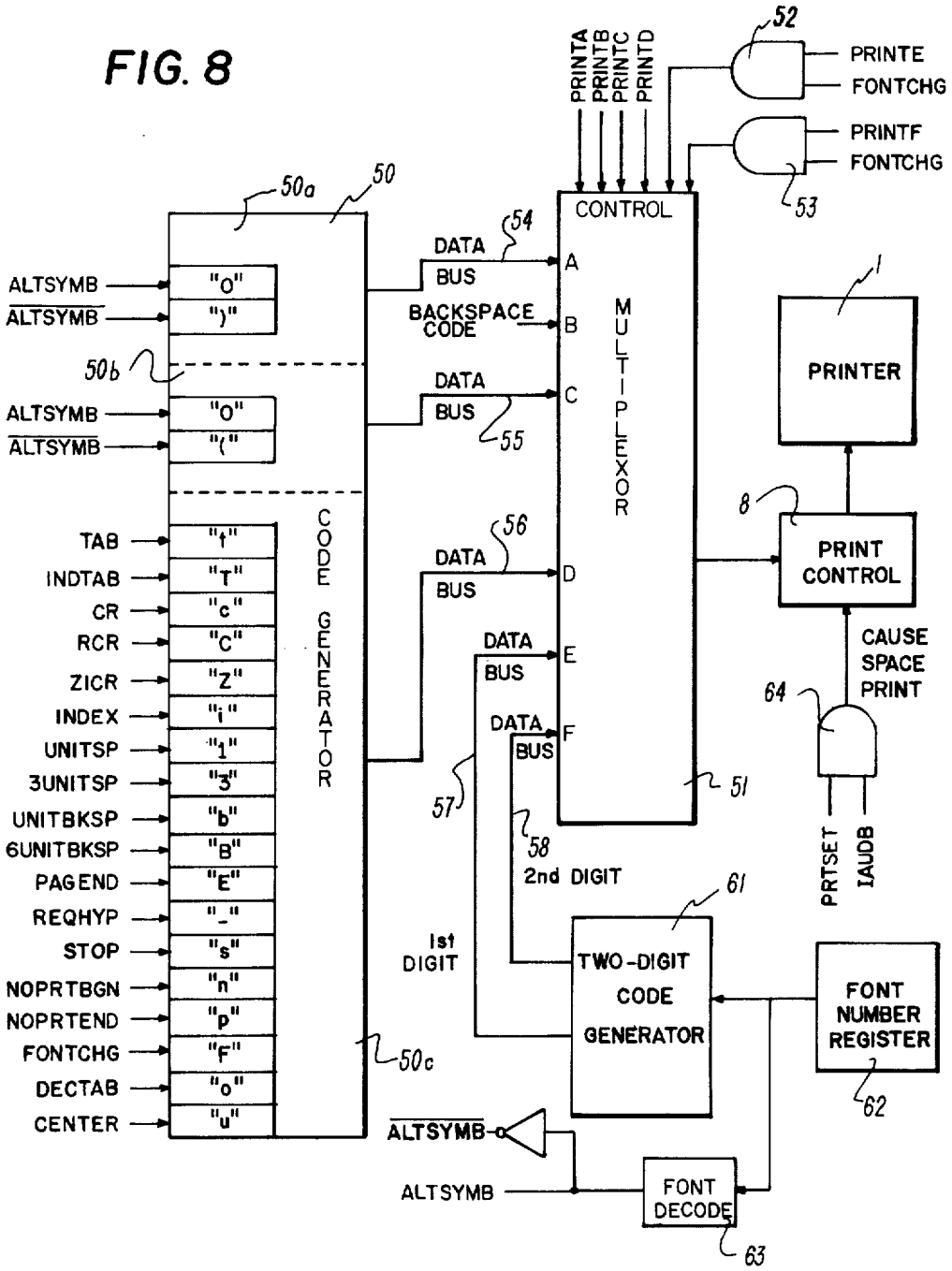
FIG. 8 is a block diagram of the controls for effecting the printing of audit print characters.

With reference now to FIG. 8, the audit print instruction code signals (from text buffer decode 13a) are coupled to the inputs of the code generator 50 which, in effect, provides the function of the audit print character generator 9 previously described with reference to FIG. 2. Specifically, the code generator 50 is composed of three "sections" 50a, 50b, and 50c, sections 50a and 50b being employed in the manner subsequently described, to generate the "identifier symbol" portion of the audit print character and a section 50c for generating the "code character" portion of the audit print character. As is apparent from FIG. 8, the receipt of the particular signal at the input to section 50c, for example, TAB, generates the corresponding code character, in this instance "t", to multiplexer 51.

Figure 9:
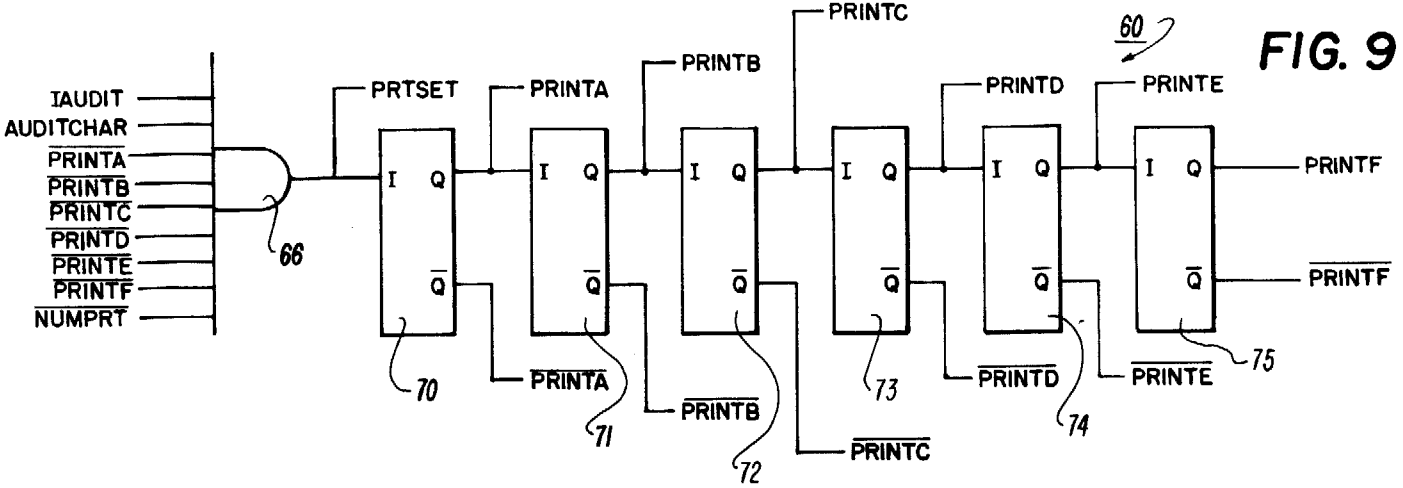
FIG. 9 detects a sequence stepper network for effecting the audit print character printout.

The identifier symbol data is inputted to a multiplexer 51 along data buses 54 and 55; and the code character data is routed to multiplexer 51 along data bus 56. The multiplexer 51, in effect, provides the function of the gate module 15 (FIG. 2)) for gating the audit print character data (identifier symbol and code character) to the print control logic 8. Such "gating" occurs in response to the outputs of AND gates 52 and 53 and/or signals (PRINTA-PRINTF) generated by a sequence stepper network 60, the details and operation of which are subsequently described (FIG. 9). Thus, upon actuation of the sequence stepper network 60, identifier symbol data (from the segments 50a and 50b) and code character data (from the segment 50c) are gated by multiplexer 51 to the print control 8 for audit print character substitution printing by printer 1.

In accordance with a particular feature of the apparatus of the present invention, the code generator 50 is capable of generating not only the normal identifier symbol (which has been referred to as the symbol "ȣ") but, when so instructed (ALTSYMB), an alternate identifier symbol (in this illustration, the symbol "ꝏ"). Thus, upon receipt of the signal ALTSYMB (decoded by font decode logic 63 from a font number register 62), the alternate identifier symbol "ꝏ" would be inputted from code generator sections 50a and 50b to the multiplexer 51. In the absence of such alternate identifier symbol instruction ($\overline{\text{ALTSYMB}}$), the sections 50a and 50b would input the normal identifier symbol "ȣ" to multiplexer 51.

In accordance with another feature of the code generator apparatus 50, it is to be noted that both the normal and alternate identifier symbols are formed by two overlapping segments respectively generated by sections 50a and 50b. For example "ȣ" is formed by a "ᴐ" "generated from section 50a and" ( "generated from segment 50b. Thus, when both segments are inputted to the multiplexer 51, along with a "backspace code", the two portions will overlap on printing, thus creating the identifier symbol "ȣ". This will also be true for the two superimposed "Os".

As previously mentioned, the "font change" code character is made up of an initial symbol designated "F" followed by a two-digit font number. This total code character then identifies not only the requirement for a font change, but also a two-digit number indicating the type of font to be used. For example, F79 might represent copperplate gothic. The current font number is normally stored in the font number register 62, the output of which is coupled to a two-digit code generator 61. Thus, upon receipt of the FONTCHG audit print instruction code, not only the "F", but also the appropriate two digits representing the particular font will sequentially be inputted (along data buses 57 and 58) to the multiplexer 51.

To briefly summarize, therefore, under control and in response to the sequence stepper network 60, the audit print substitution printing by printer 1 will occur in the following sequence: (1) an initial printing of the identifier symbol (either normal or alternate), (2) next, the particular code character (corresponding to the particular audit print instruction code); and (3) then a two-digit font number if the audit print instruction code indicates a font change. This audit print character printout will therefore be substituted for the usual functional response at the appropriate location with the text printout to produce a combined printout similar to that previously reproduced and entitled "Audit Print Sample".

With reference again to FIG. 8, it is to be pointed out that an AND gate 64 has its output also coupled to an input of print control 8. This is actually a supervisory control which assures that the audit print character, particularly the identifier symbol, does not overprint a text character (in the case of the preceding dead key character); and therefore spaces the carrier (before printing) over one position upon the occurrence of the signal conditions IAUDB and PRTSET. IAUDB is present under the "set" conditions of latch 65 (FIG. 10); and PRTSET is a one-cycle pulse from AND gate 66 (FIG. 9) initiating the printing of the audit print character.

Referring now to FIG. 9, the sequence stepper network 60 comprises a plurality of series-connected shift registers 70–75 connected to the output of AND gate 66. Thus, when an audit print character is to be substituted (occurrence of IAUDIT and AUDITCHAR and the other signal conditions at input to AND gate 66), PRTSET is "1", thus sequentially initiating the print signals PRINTA-PRINTF. These sequence stepper signals then gate the identifier symbol and code character data through the multiplexer 51, as previously described, to the print control 8. As apparent from AND gates 52 and 53 (FIG. 8), it is noted that the sequence stepper signals PRINTE and PRINTF control the printing of the font digits. As previously described, during the audit print character substitution, the text character printing temporarily ceases (AUDITCHAR input to OR gate 23).

In accordance with a particular feature of the invention, the audit print instruction codes are only printed and not executed during Audit Print, but certain ones of these codes also initiate a functional response after their respective print substitution. Specifically, and with reference now to FIG. 11, the carrier return (CR), required character return (RCR), platen advance (INDEX), and zero-index carrier return (ZICR) codes require a carrier return to be performed after their respective printing. This occurs at PRINTE time, as indicated by the OR gate 67 and AND gate 68 producing the CAUSE CARRIER RETURN signal from the OR gate 69 to the print control 8. Additionally, and by reference to FIG. 6, the end of page (PAGEND) audit print instruction code terminates Audit Print playout (after its print) at PRINTF time (AND gate 33, OR gate 36, and AND gate 37).

The AUDITSET signal is also effective to generate a modified line return command to the text buffer control 12 (FIG. 6) to return the control flag to the beginning of the line (if not already there), as well as to output a CAUSE CARRIER RETURN signal to the print control 8 (AND gate 80 of FIG. 11) if the carrier is not already at the start of a new line. As subsequently described, AUDITSET will also initiate the playout of the first reference line number.

It is to be noted at this point that certain instruction codes which are not audit print instruction codes, for example mode/measure codes, tab/index codes, and minimum interword space codes, are also printed out during Audit Print; but rather than intermixed with the text characters, as are the audit print instruction codes, these codes are printed on separate lines. This result is accomplished under control of the gates 81, 82, and 69 depicted in FIG. 11, with the CAUSE CARRIER RETURN signal consequently being generated to the print control 8, the START NEW LINE signal also being employed to set IAUDB, as indicated in FIG. 10.

PRINTING OF REFERENCE LINE NUMBERS

The logic circuitry for effecting the printing of the reference line numbers during Audit Print, as briefly discussed with reference to FIG. 2, is now described in greater detail. Preliminary to such description, it would be useful to initially discuss the method and apparatus for generating certain signals utilized for controlling such reference line number printout.

Figure 15:
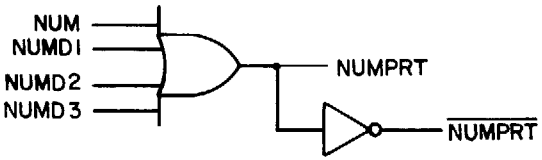

Accordingly, and with initial reference to FIG. 12, a sequence stepper network 90 comprises a plurality of series-connected shift registers 86–88 coupled to the output of an AND gate 85. Thus, when the system is in Audit Print mode (IAUDIT), and the other inhibiting conditions (represented by the data complement signals to AND gate 85) are not present, NUM is "high", thus initiating the stepper signals (NUMD1-NUMD3). FIG. 15 depicts the logic which indicates whether the reference line numbers are (NUMPRT) or are not ($\overline{\text{NUMPRT}}$) being processed for printing.

The logic circuitry for generating the IAUDZ signal which indicates whether it is time to print a reference line number (IAUDZ low) is depicted in FIG. 13, such circuitry including a latch 91 which is "set" when a reference line number print is completed (NUMD3) and is "reset" by the return of the carrier (carriage) to the left margin or the initiation of Audit Print. When IAUDZ is "low", the need to print a reference line number is indicated. It is also noted that FIG. 13 depicts the latch 92 for generating the IAUDR signal, as previously discussed.

Referring now to FIG. 14, the apparatus for effecting the reference line number printout during Audit Print mode comprises a pair of modulo-10 counters 76 and 77 (which, in effect, provide the function of the reference line number module 16 of FIG. 2) and a four-bit multiplexer 78 (which, in effect, provides the function of the gate 17 of FIG. 2). Outputs from counter 76 and 77 are respectively coupled to the A and B inputs to the multiplexer 78. A third input C to the multiplexer enables the entry of space position codes to the print control logic 8.

The counters 76 and 77 which store the next reference line number to be printed, are initially set to 01 at the beginning of Audit Print (presence of AUDITSET), and are incremented once after each reference line number is printed provided IAUDB is low (under control of AND gate 92).

Under the principal control of the signal IAUDB (or its data complement $\overline{\text{IAUDB}}$, the multiplexer 78 is effective to gate the proper codes to the print control 8 during a reference line number printout. The control signals IAUDB or $\overline{\text{IAUDB}}$ are employed to assure that only accessible lines of text during Audit Print mode are preceded by a reference line number. Thus, and with the use of the gates 93–97 connected in the manner illustrated in FIG. 14, if IAUDB is off, the multiplexer 78 initially gates the highest order digit, then the lowest order digit, then a space position code to the print control logic 8. If IAUDB is on, however, the multiplexer 78 only gates three space position codes to the print control logic 8 without any reference digits being outputted therefrom. The "setting" of IAUDB (and thus the inhibition of the printing of reference line numbers) occurs in response to the carrier (carriage) returning to the left margin in response to a code that does not indicate a line boundary.

It is contemplated that various changes and additions to the aforedescribed process and apparatus may be made by one skilled in the art without departing from the basic concept of the present invention. For example, the particular type and number of audit print instruction codes (and corresponding audit print characters) may be different in various types of systems, depending upon the results and objectives being sought. Furthermore, while the aforementioned description of the process and apparatus of Audit Print has been directed to the actual printing of the text characters, audit print characters, and reference line numbers, the same concepts and techniques are equally applicable to any type of operator readable output, including a wide variety of visual displays.

Various other modifications to the disclosed embodiments, as well as alternate embodiments, of the process and apparatus of the present invention may become apparent to those skilled in the art without departing from the spirit and scope of the invention as defined by the appended claims.

What is claimed is:

1. Word processing apparatus, comprising:

(a) an output printer, (b) input keyboard means for generating text codes representative of text to be printed by said output printer and instruction codes representative of the format by which said text is to be printed, (c) memory means for storing said text codes and instruction codes, (d) first control means for outputting said text codes and said instruction codes from said memory means, (e) second control means for controlling the printing of characters by said output printer, (f) decode means in communication with said memory means for selecting said instruction codes outputted by said memory means, (g) first gate means in communication with said memory means and said second control means, said first gate means, when actuated, enabling the passage of text codes from said memory means to said second control means, thereby to actuate said printer to print a set of text characters corresponding to said text codes, (h) character generator means in communication with said decode means for generating audit print character codes representative of selected ones of said instruction codes outputted from said memory means, said audit print character codes being substituted for printer execution of said instruction codes, (i) second gate means communicating with said character generator means and said second control means, said second gate means, when actuated, enabling the passage of said audit print character codes to said second control means, thereby to cause said printer to print a set of audit print characters corresponding to said audit print character codes, and (j) third means for selectively and alternately actuating said first gate means to pass said text codes to said second control means and said second gate means to pass said audit print character codes to said second control means to produce printed lines of intermixed ones of said text and audit print characters.

2. The apparatus as defined by claim 1 further comprising a reference line number code generator, and third gate means communicating with said reference line number code generator and said second control means, said third gate means, when actuated, sequentially gating said reference line number codes to said second control means, thereby to actuate said printer to print reference line number characters preceding each accessible ones of said printed lines.

3. The apparatus as defined by claim 1 wherein each of said audit print characters comprises an initial identifier symbol which is common to all audit print characters and a code character symbol uniquely associated with the type of audit print character code, and wherein said audit print character generator means comprises a first section for storing codes representative of said initial identifier symbol and a second section for storing codes representative of said code character symbols, third control means in communication with said first and second sections for generating said initial identifier symbol codes in response to the outputting from memory of selected ones of said instruction codes.

4. The apparatus as defined by claim 3 wherein said first section also has stored therein a code representative of an alternate form of said initial identifier symbol, and further comprising fourth control means for generating said alternate form code.

5. The apparatus as defined by claim 1 further comprising means for preventing the actuation of said first gate means when said second gate means is actuated and for preventing the actuation of said second gate means when said first gate means is actuated.

6. The apparatus as defined by claim 5 further comprising means for storing a code representative of the font in which said text is to be printed, said font code comprising a first portion corresponding to an instruction code indicating the necessity for a font change and a second portion identifying the type of font.

7. The apparatus as defined by claim 1 further comprising means for effecting a functional response of said printer subsequent to the printing of selected ones of said audit print characters.

8. The apparatus as defined by claim 7 wherein said functional response is a carrier return.

9. The apparatus as defined by claim 7 wherein said functional response terminates the generation of audit print character codes.

* * * * *

UNITED STATES PATENT AND TRADEMARK OFFICE

CERTIFICATE OF CORRECTION

PATENT NO. : 4,220,417

DATED : September 2, 1980

INVENTOR(S) : C. N. Sprott, et al

It is certified that error appears in the above-identified patent and that said Letters Patent are hereby corrected as shown below:

Column 5, Chart, line 20 - preceding "E", insert --I --.
Column 6, Chart, line 52 - delete "oerator" and insert therefor --operator--.
Column 7, line 1 - delete "bksp is" and insert therefor --bksp/s--; line 2 - delete "bksp6" and insert therefor --bksp6s--; line 23 - following "09", insert --1--; line 25 - preceding "T", insert --I --.
Column 8, ALTLAT - delete "initiating" and insert --in--.
Column 9, START NEW LINE, line 2 - following "a", insert --non--; AUDITRESET, line 1 - delete "IAUDIT" and insert therefor --IAUDIT--.

Signed and Sealed this

*Twenty-first* Day of *April 1981*

[SEAL]

*Attest:*

RENE D. TEGTMEYER

*Attesting Officer* *Acting Commissioner of Patents and Trademarks*